United States Patent [19]

Koike

[11] Patent Number: 4,861,291

[45] Date of Patent: Aug. 29, 1989

[54] MARINE ENGINE PROTECTION DEVICE

[75] Inventor: Takashi Koike, Hamamatsu, Japan

[73] Assignee: Sanshin Kogyo Kabushiki Kaisha, Hamamatsu, Japan

[21] Appl. No.: 92,182

[22] Filed: Sep. 2, 1987

[30] Foreign Application Priority Data

Sep. 10, 1986 [JP] Japan ..... 61-213436

[51] Int. Cl.[4] ..... B63H 21/26

[52] U.S. Cl. ..... 440/1; 440/87; 440/2; 440/88

[58] Field of Search ..... 440/1, 2, 84, 87, 53, 440/88; 123/198 DC, 333, 335

[56] References Cited

U.S. PATENT DOCUMENTS

| | | | |
|---|---|---|---|
| 2,635,576 | 4/1953 | Kiekhaefer | 440/87 X |
| 3,020,777 | 2/1962 | Burkett | 123/198 BC |
| 3,641,965 | 2/1972 | Schmiedel | 440/61 X |
| 4,005,674 | 2/1977 | Davis | 440/1 |
| 4,100,877 | 7/1978 | Scott et al. | 440/87 X |
| 4,734,065 | 3/1988 | Nakahama et al. | 440/1 |

*Primary Examiner*—Sherman D. Basinger
*Attorney, Agent, or Firm*—Ernest A. Beutler

[57] ABSTRACT

Several embodiments of marine outboard drives including devices for protecting the unit in the event of tilting up more than a predetermined extent. The protection devices slow the engine when the outboard drive is tilted up more than the predetermined amount. This may be done by interrupting the spark, retarding the spark advance or closing a throttle. The invention is disclosed in combination with either an outboard motor having an underwater inlet for cooling the engine or an outboard drive portion of an inboard-outboard drive having a stabilizer for holding the outboard drive during a portion of its trim adjusted movement.

16 Claims, 3 Drawing Sheets

MARINE ENGINE PROTECTION DEVICE

BACKGROUND OF THE INVENTION

This invention relates to a marine engine protection device and more particularly for an improvement for protecting the engine of the marine propulsion unit in the event the drive unit is tilted up to an excessively high position considering the running speed of the engine.

It is well know to pivotally support a marine outboard drive for movement about a horizontally extending tilt axis so as to adjust the trim position of the propulsion drive and also so as to permit it to be tilted up out of the water when not in use. This is typically done with either outboard motors per se or the outboard drive unit of an inboard-outboard drive. In each application certain problems can arise if the outboard drive is tilted up excessively while the engine speed is maintained at a high value.

With an outboard motor, for example, the water inlet for the cooling of the outboard motor is normally positioned within the lower unit of the outboard motor. Cooling water is drawn from this inlet through a water pump and is circulated through the engine for discharge back into the body of water in which the outboard motor is operating. However, if the outboard motor is tilted up excessively, the water inlet may be at least partially exposed to the atmosphere rather than to the water. This can result in loss of cooling for the engine.

With the outboard drive unit of an inboard-outboard drive, the outboard drive is normally supported for pivotal movement by means of gimbal arms. These gimbal arms normally have extending surfaces that engage the outer portion of the lower unit during its trim operation so as to provide stability. However, if the outboard drive is tilted up so that this engagement no longer exists and the engine is operated at high speeds, the vibrations can cause problems and possible damage to the unit. In addition, serious damage might result during steering movement during such a tilted-up condition.

It is, therefore, a principle object of this invention to provide an arrangement for protecting a marine outboard drive from damage if it is tilted up more than a predetermined amount.

It is a further object of this invention to provide an arrangement for reducing the speed of the driving engine when the marine propulsion outboard drive is tilted up more than a predetermined amount.

SUMMARY OF THE INVENTION

This invention is adapted to be embodied in a marine outboard drive that is adapted to be mounted on the transom of a watercraft and which carries propulsion means. The mounting of the outboard drive permits adjustment on the height of the propulsion means relative to the transom. Power means are provided for driving the propulsion means and means are incorporated for sensing the height of the propulsion means. The speed of the power means is reduced when the height of the propulsion means exceeds a predetermined volume.

DETAILED DESCRIPTION OF THE PREFERRED EMBODIMENTS

Figure 1:
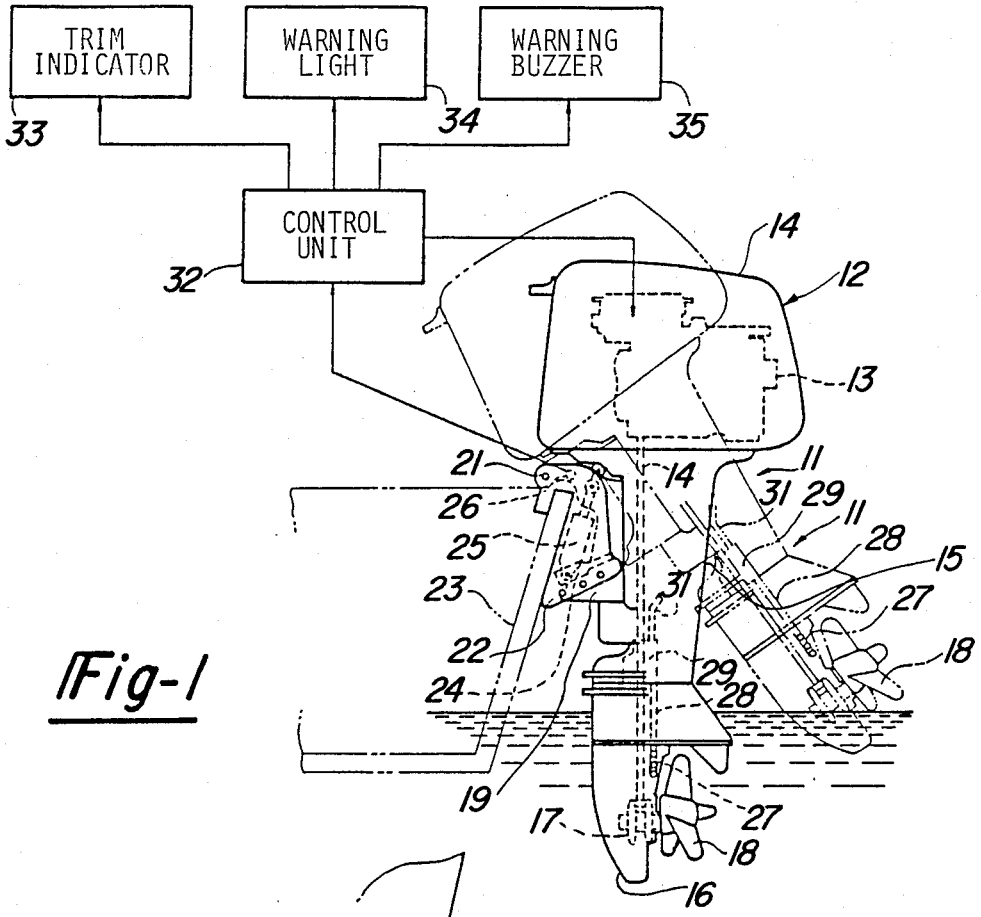
FIG. 1 is a partially schematic side-elevational view showing an outboard motor attached to the transom of an associated watercraft and constructed in accordance with a first embodiment of the invention.

Referring first to FIG. 1, a generally conventional outboard motor constructed in accordance with an embodiment of the invention is identified generally by the reference numeral 11. The invention does not deal with the specific construction of the outboard motor 11 per se and for that reason the details of the construction are not necessary to understand the construction and operation of the invention. However, the outboard motor 11 includes a powerhead, indicated generally by the reference numeral 12 which includes a powering internal combustion engine 13 which may be of the spark-ignited type, and which is encircled by a protective cowling 14.

The output shaft of the engine shaft 13 is drivingly coupled to a driveshaft 14 that is journaled in a known manner within a driveshaft housing 15 which depends from and is affixed to the powerhead 12 in an appropriate manner. A lower unit 16 contains a forward-neutral-reverse transmission 17 for driving a propeller 18 from the driveshaft 14 in a known manner.

A steering shaft (not shown) is affixed to the driveshaft housing 15 and is journaled within a swivel bracket 19 for steering of the outboard motor 11 about a generally vertically extending axis. The swivel bracket 19 is pivotally connected, by means of a pivot pin 21, to a clamping bracket 22 that is affixed in a suitable manner to a transom 23 of an associated watercraft. The pivotal connection between the swivel bracket 19 and the clamping bracket 22 permits trim adjustment of the outboard drive 12 and, specifically, of the propeller 18 through a range as shown by the solid and phantom line views in FIG. 1. In addition, the outboard motor 11 may be pivoted up to an out-of-the-water condition as is well known in this art.

The tilt and trim position of the outboard motor 11 may be controlled by means of a hydraulic trim cylinder 24 that is affixed to the clamping bracket 22 and which engages the swivel bracket 19 for effecting its pivotal movement. In addition, there is provided a tilt fluid motor 25 that is pivotally connected between the clamping bracket 22 and the swivel bracket 19 for effecting tilting up movement of the outboard motor 11. This tilt and trim arrangement is well known in the prior art and any of the types used for this purpose may be employed.

There is also provided a trim position sensor 26 that senses the trim position of the outboard motor about the pivot pin 21.

Although the invention is described in conjunction with an arrangement wherein the outboard motor 11 is supported for pivotal movement about a fixed pivot axis so as to achieve trim adjustment, it is to be understood that the invention may be employed with other types of outboard drive mountings wherein the height or trim angle of the propulsion unit is adjusted.

The outboard motor 11 and specifically the engine 13 are provided with a cooling system that includes a water inlet 27 that is formed within the lower unit 16 in proximity to the propeller 18. Water is delivered from the water inlet 27 through a conduit 28 to a coolant pump 29 that is driven by the driveshaft 14 in a known manner. The water pump 29 discharges coolant through a conduit 31 for flow upwardly to the engine 13 for its cooling. The cooling water that has been circulated through the engine is redischarged back to the body of water in which the outboard motor 11 is operating in a known manner.

As should be readily apparent from FIG. 1, the construction of the water inlet 27 is such that as the outboard motor 11 is tilted up, eventually a point will be reached where the water inlet 27 will be only partially submerged. If the outboard motor 11 is operated at high speeds under this condition, there may be inadequate cooling for the engine 13. In accordance with the invention, an arrangement is incorporated for preventing such situations.

This system is shown schematically in FIG. 1 and includes a control unit 32 that receives signals from the trim angle sensor 26 and the engine 13. In addition, the control unit 32 transmits controlling signals to the engine 13 in a manner which will become apparent. The control unit 32 also provides an output signal to a trim indicator 33 to provide the operator with an indication of the actual trim condition of the outboard motor 11. Furthermore, the control unit 32 provides an output signal, under certain conditions as to be described, to a warning light 34 and to a warning buzzer 35 that are positioned in proximity to the watercraft operator so as to indicate a potentially dangerous situation.

Figure 2:
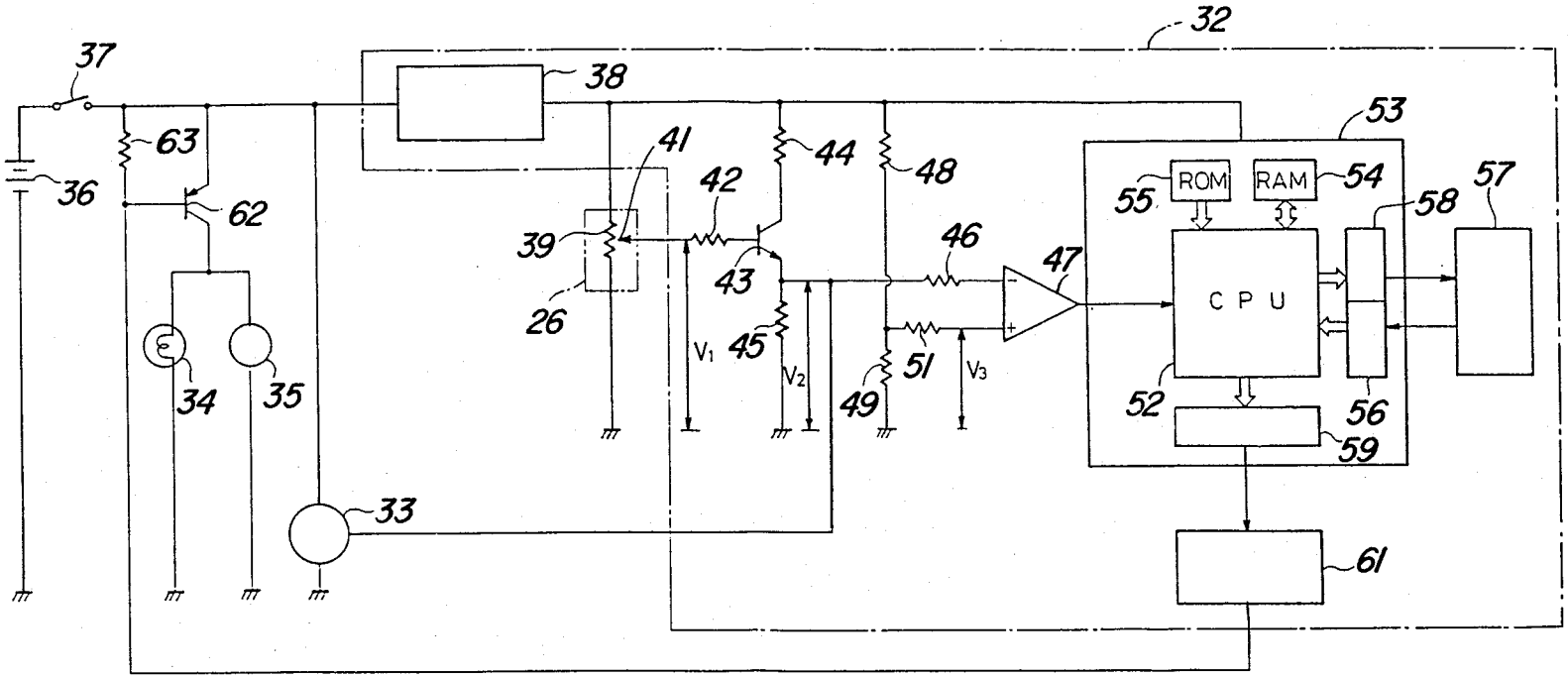
FIG. 2 is a schematic electrical diagram showing the control system.

FIG. 2 is an electrical diagram showing the relationship of the control unit 32 to the other components and is helpful in understanding how the system operates. Referring to this figure, an electrical power source such as a battery 36 is in circuit with a main power switch 37 and a constant voltage source 38 such as a voltage regulator of the control unit 32. The constant voltage source 38 outputs a constant voltage to a resistor, which forms a component of the trim angle sensor 26, which resistor is identified by the reference numeral 39. A wiper 41 contacts the resistor 39 and varies the output voltage dependent upon the angular position of the outboard motor 11 ($V_1$) supplied to a biasing resistor 42.

The resistor 42 applies the voltage signal $V_1$ to the base of a control transistor 43 which is in circuit between a biasing resistor 44 and a further biasing resistor 45 for impressing an output voltage ($V_2$) through an input resistor 46 to one terminal of a comparator 47. By employing the control transistor 43, it is possible to apply the output to both the comparator 47 and to the trim position indicator 33 so as to provide the trim indication. As such, the circuit avoids the necessity for having separate impedance changing devices for driving the indicator 33 or a trim limit switch for indicating the trim position.

The other terminal of the comparator 47 receives a fixed voltage reference signal ($V_3$) from a pair of dividing resistors 48 and 49 and an input resistor 51. If the trim of the outboard motor 11 exceeds a predetermined amount, as set by the reference voltage $V_3$, the comparator 47 will output a signal indicative of this fact to a CPU 52. CPU 52 forms a component of a microprocessor, indicated generally by the reference numeral 53 which includes a RAM 54 and ROM 55. In addition, the CPU includes an input interface 56 that receives an engine speed signal from the engine ignition circuit 57. Furthermore, the microprocessor 53 includes an output interface 58 that can output a speed limiting signal to the engine ignition circuit 57.

The microprocessor 53 also includes a further output interface 59 that outputs a signal to a driving circuit 61 that activates a base of a transistor 62 through a resistor 63 to switch the transistor 62 on and illuminate the warning light 34 and activate the warning buzzer 35.

Figure 3:
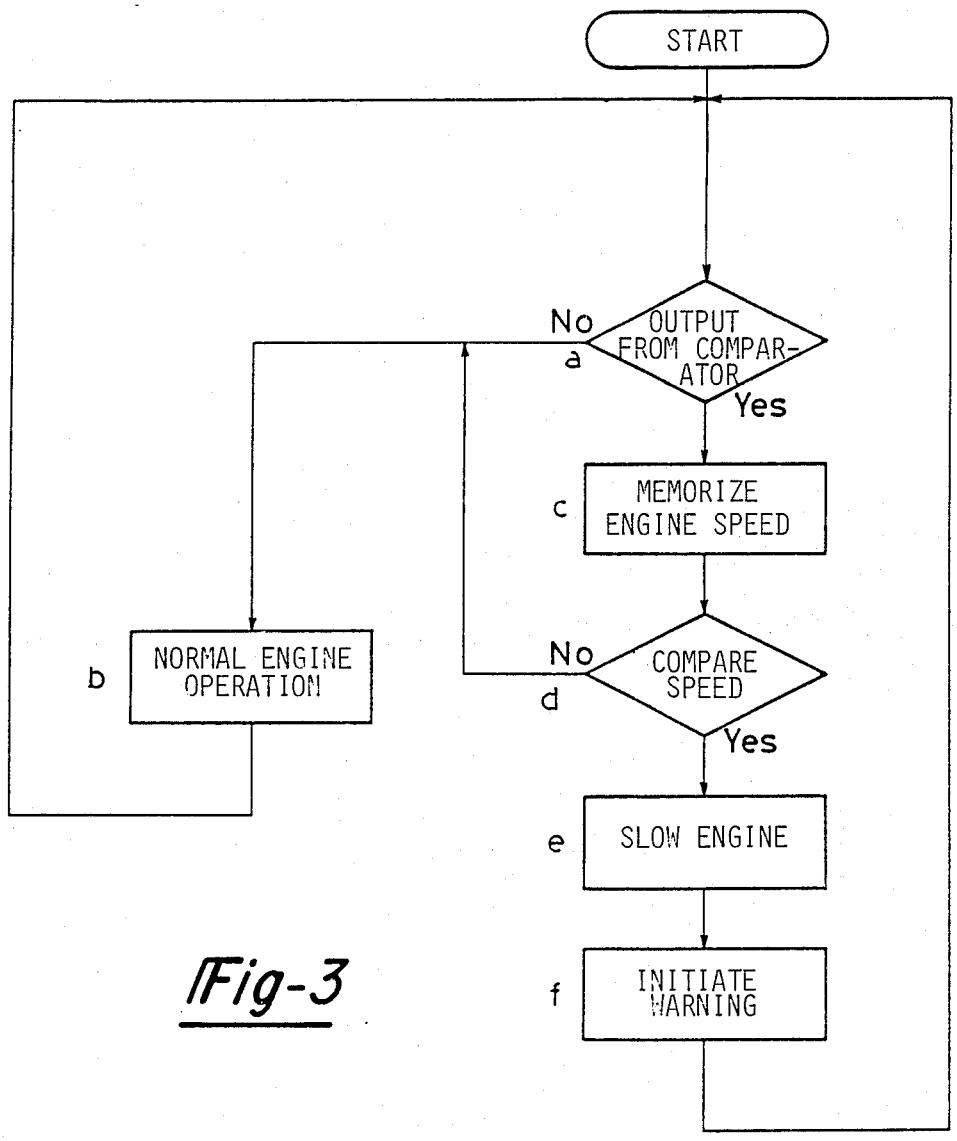
FIG. 3 is a schematic block diagram showing the logic for the computer control of this system.

The programming of the microprocessor 53 may be best understood from the block diagram of FIG. 3 wherein the logic of the system is depicted. After the starting of the program, the CPU moves to the step a wherein it is determined if the trim angle of the outboard motor 11 is more than the predetermined or preset trim angle. This is sensed when the comparator 47 outputs a signal. If the predetermined trim angle is not exceeded, the device permits normal engine operation at step b. If, however, the predetermined trim angle is exceeded and the comparator outputs a signal. At the step c, the actual engine speed as determined by the input from the input interface 56, is memorized in the ram. Then at step d, it is determined if the engine speeds exceeds the predetermined maximum safe engine speed for the trim of the engine. If it is determined that the engine speed is not in excess of the speed which requires correction, the engine speed is not reduced by spark interruption or by the other methods hereinafter described as the step b.

If desired, the comparitor 47 may be dispensed with and the actual comparison may be accomplished within the CPU 52. In this instance, the position sensing device 26 will output its signal directly to the CPU 52 and the CPU 52 will receive this signal through a suitable input interface and provide the internal comparison along with a predetermined program in order to determine if the trim angle exceeds the trim angle at which engine speed reduction may be required.

If, on the other hand, the predetermined maximum safe speed is reached or exceeded, at step e the engine speed is slowed. This is done through an output signal through the output interface 58 which will interrupt the ignition circuit 57 or otherwise slow the engine. This may be done by interrupting the ignition by means of a circuit of the type shown in U.S. Pat. No. 4,459,951, issued July 17, 1984 and entitled "Overheat Preventing System For an Internal Combustion Engine" or that shown in U.S. Pat. No. 4,606,315, issued Aug. 19, 1986 and entitled "Ignition Control System For an Internal Combustion Engine". Various other forms of speed reduction including those embodying throttle position actuators or a spark retardation may be used in accordance with the invention.

Simultaneously with the reduction of engine speed, the computer outputs a signal at step f through the interface 59 so as to initiate a warning signal by illuminating the warning light 34 and sounding the buzzer 35.

Figure 4:
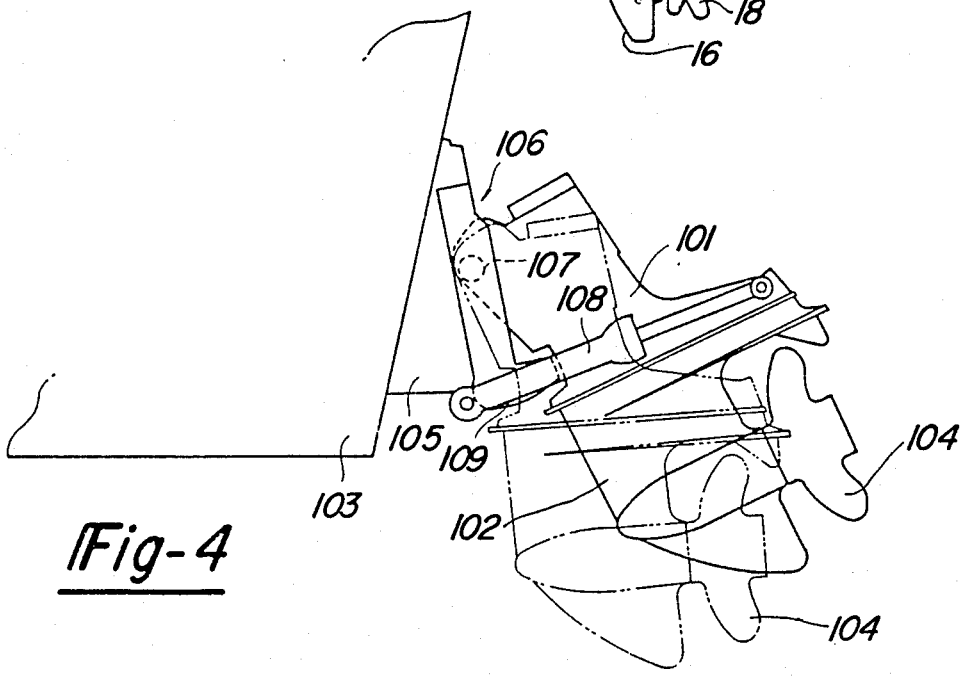
FIG. 4 is a side elevational view of another embodiment of the invention as applied to the outboard drive unit of an inboard-outboard drive.

In the embodiment thus far described, the device is operated to prevent overheating of an outboard motor when the trim condition exceeds a predetermined trim angle by reducing engine speed. FIG. 4 shows another embodiment of the invention that is utilized in conjunction with an inboard-outboard drive including an outboard drive housing assembly 101. The outboard drive housing assembly 101 includes a lower unit 102 that includes a forward-neutral-reverse transmission (not shown) which is driven from an engine (not shown)

mounted within the hull 103 of an associated watercraft. This transmission drives a propulsion unit such as a propeller 104 in a known manner.

Outboard drive unit 101 is supported by means of a transom bracket assembly or gimbal housing 105 that is affixed to the watercraft transom in a known manner. The gimbal housing 105 supports a gimbal support ring 106 that defines a tilt axis 107 about which the outboard drive 101 pivots.

Pivotal movement of the outboard drive unit 101 about the pivot axis 107 is accomplished by means of a pair of fluid motors 108 in the known manner. A pair of lower support arms 109 of the gimbal ring 47 engage the housing of the outboard drive 101 during normal trim movement so as to provide stability and reinforcing and to control the position of the outboard drive. However, once the outboard drive 101 is pivoted up more than a predetermined amount, the arms 109 no longer engage the housing 101 and provide the support. At this time, the speed of the driving engine will be reduced through a circuit and logic, as aforedescribed, so as to protect the device.

It should be readily apparent that the foregoing described two embodiments of the invention as applied to either an outboard drive of an inboard-outboard drive or an outboard motor per se wherein protection is afforded if the outboard drive is tilted up more than a predetermined amount.

Although several embodiments of the inventions have been illustrated and described, various changes and modifications may be made without departing from the true scope and spirit of the invention, as defined by the appended claims.

I claim:

1. A marine outboard drive adapted to be mounted on the transom of a watercraft and carrying propulsion means, said mounting of said outboard drive permitting adjustment of the height of said propulsion means relative to the transom, an internal combustion engine for driving said propulsion means and wherein operation of said propulsion means at a height greater than a predetermined height and at a speed greater than a predetermined speed is likely to cause damage to said outboard drive, means for sensing the height of said propulsion means and for providing an output signal when said propulsion means is operated at a speed greater than the predetermined speed and when the height of said propulsion means is greater than the predetermined height, and means for reducing the speed said internal combustion engine drives said propulsion means when said means for sensing provides such output signal for avoiding said damage to said outboard drive.

2. A marine outboard drive adapted to be mounted on the transom of a watercraft as set forth in claim 1 where the internal combustion engine is spark ignited.

3. A marine outboard drive adapted to be mounted on the transom of a watercraft as set forth in claim 2 wherein the speed of the engine is reduced by interrupting the spark.

4. A marine outboard drive adapted to be mounted on the transom of a watercraft as set forth in claim 2 wherein the speed of the engine is reduced by retarding the timing of the engine ignition system.

5. A marine outboard drive adapted to be mounted on the transom of a watercraft as set forth in claim 2 wherein the speed of the engine is reduced by closing a throttle of the engine.

6. A marine outboard drive as set forth in claim 1 wherein the speed the internal combustion engine drives the propulsion means is reduced by reducing the speed of said internal combustion engine.

7. A marine outboard drive adapted to be mounted on the transom of a watercraft as set forth in claim 6 wherein the outboard drive includes a water inlet for a water cooling jacket of the engine positioned contiguous to the propulsion means and the output signal is generated when the height of said water inlet is such that insufficient cooling water for the engine may be drawn through said water inlet.

8. A marine outboard drive adapted to be mounted on the transom of a watercraft as set forth in claim 7 wherein the engine is spark-ignited.

9. A marine outboard drive adapted to be mounted on the transom of a watercraft as set forth in claim 8 wherein the speed of the engine is reduced by interrupting the spark.

10. A marine outboard drive adapted to be mounted on the transom of a watercraft as set forth in claim 8 wherein the speed of the engine is reduced by retarding the timing of the engine ignition system.

11. A marine outboard drive adapted to be mounted on the transom of a watercraft as set forth in claim 8 wherein the speed of the engine is reduced by closing the throttle of the engine.

12. A marine outboard drive adapted to be mounted on the transom of a watercraft as set forth in claim 1 wherein the outboard drive comprises the outboard drive unit of an inboard-outboard drive having stabilizing means for controlling the position of the outboard drive from a trimmed down position to the height sensed and the output signal is generated when the speed of the propulsion means and the height is such that the stabilizing means does not control the position of the outboard drive and excessive loads may be placed on said outboard drive.

13. A marine outboard drive adapted to be mounted on the transom of a watercraft as set forth in claim 12 wherein the propulsion means comprises a spark-ignited internal combustion engine.

14. A marine outboard drive adapted to be mounted on the transom of a watercraft as set forth in claim 13 wherein the speed of the engine is reduced by interrupting the spark.

15. A marine outboard drive adapted to be mounted on the transom of a watercraft as set forth in claim 13 wherein the speed of the engine is reduced by retarding the timing of the engine ignition circuit.

16. A marine outboard drive adapted to be mounted on the transom of a watercraft as set forth in claim 12 wherein the speed of the engine is reduced by closing the throttle of the engine.

* * * * *